US010210833B2

(12) United States Patent
Koudo et al.

(10) Patent No.: US 10,210,833 B2
(45) Date of Patent: Feb. 19, 2019

(54) DISPLAY DEVICE

(71) Applicant: Panasonic Liquid Crystal Display Co., Ltd., Hyogo (JP)

(72) Inventors: Toshikazu Koudo, Hyogo (JP); Katsuji Tanaka, Hyogo (JP); Makoto Arita, Hyogo (JP); Kazusa Miyaji, Hyogo (JP); Ikuko Mori, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 0 days.

(21) Appl. No.: 15/475,178

(22) Filed: Mar. 31, 2017

(65) Prior Publication Data

US 2018/0286339 A1 Oct. 4, 2018

(51) Int. Cl.
*G09G 3/00* (2006.01)
*G09G 3/36* (2006.01)

(52) U.S. Cl.
CPC ..... *G09G 3/3677* (2013.01); *G09G 3/3688* (2013.01); *G09G 2300/023* (2013.01); *G09G 2300/0452* (2013.01); *G09G 2310/08* (2013.01); *G09G 2340/0464* (2013.01)

(58) Field of Classification Search
CPC ..... G09G 2300/023
USPC ..... 345/682
See application file for complete search history.

(56) References Cited

U.S. PATENT DOCUMENTS 5,031,044 A * 7/1991 Canfield ..... H04N 5/45 348/565
8,451,201 B2 * 5/2013 Hirata ..... G02F 1/13471 345/1.1
9,794,534 B2 * 10/2017 Le Houerou ..... H04N 9/3147
2004/0252076 A1 * 12/2004 Kodama ..... G09G 3/3208 345/3.1
2007/0252804 A1 * 11/2007 Engel ..... G09G 3/36 345/98
2010/0118006 A1 * 5/2010 Kimura ..... G09G 3/3611 345/205
2010/0333006 A1 * 12/2010 Ostergard ..... G02B 26/005 715/768
2011/0043435 A1 * 2/2011 Hebenstreit ..... G02B 26/005 345/5
2011/0157169 A1 * 6/2011 Bennett ..... G06F 3/14 345/419
2011/0227810 A1 * 9/2011 McKinney ..... G06F 1/1626 345/1.3

(Continued)

*Primary Examiner* — Phong X Nguyen
(74) *Attorney, Agent, or Firm* — HEA Law PLLC

(57) ABSTRACT

A display device includes a primary display area which comprises a first display area and a second display area which is unique from the first display area, a control unit configured to display an image in the primary display area, an image signal generating unit configured to generate display data based on externally input image data for a single image. The image signal generating unit comprises a memory which stores display-position information indicating a display location of a first image displayed in the primary display area. The display data comprises first and second display data to be displayed in the first display area and the second display area, respectively. The first display data is generated based on the externally input single image data and the display-position information. The control unit is configured to cause a first image to be displayed in the first display area based on the first display data.

16 Claims, 19 Drawing Sheets

(56) References Cited

U.S. PATENT DOCUMENTS

2012/0032972 A1* 2/2012 Hwang ..... G06F 3/0488
345/592
2013/0100379 A1* 4/2013 Haynes ..... G02F 1/133308
349/62
2013/0141310 A1* 6/2013 Joo ..... G09G 5/00
345/4
2013/0201176 A1* 8/2013 Lee ..... G09G 5/003
345/214
2013/0271445 A1* 10/2013 Park ..... G09G 5/003
345/212
2015/0185553 A1* 7/2015 Park ..... G02F 1/133509
349/58
2015/0228217 A1* 8/2015 Perdices-Gonzalez .....
G09G 3/348
345/5
2015/0279256 A1* 10/2015 Kobayashi ..... G09G 3/36
345/694
2018/0275814 A1* 9/2018 Hosokawa ..... G06F 3/0416
2018/0286339 A1* 10/2018 Koudo ..... G09G 3/3677

* cited by examiner

DISPLAY DEVICE

TECHNICAL FIELD

The present disclosure relates to a display device.

BACKGROUND

The present disclosure relates to a display device, and, in particular, to a display device which displays an image. Display devices can display images, and thus are utilized in televisions or monitors, for example.

A display user and a display supplier sometimes desire to shift a location of a display image in a display portion. For example, a display device is proposed in which two display panels are stacked, one on top of another, to allow display of an image having a contrast ratio. In this case, these two panels are stacked such that one pixel in one panel can be strictly positioned to overlap one corresponding pixel in another panel in a plan view. However, it is very difficult to match two display panels without off-setting any pixels.

The present disclosure is made to solve such problems and has an object to provide a display device which can easily shift a display position within a display portion.

SUMMARY

The present disclosure has been made in view of the above circumstances, and an object thereof is to be able to easily shift a display position within a display portion.

In one general aspect, the instant application describes a display device including a primary display area which comprises a first display area and a second display area which is unique from the first display area, a control unit configured to display an image in the primary display area, an image signal generating unit configured to generate display data based on externally input image data for a single image. The image signal generating unit comprises a memory which stores display-position information indicating a display location of a first image displayed in the primary display area. The display data comprises first and second display data to be displayed in the first display area and the second display area, respectively. The first display data is generated based on the externally input single image data and the display-position information. The control unit is configured to cause a first image to be displayed in the first display area based on the first display data.

The above general aspect may include one or more of the following features. The image signal generating unit may be configured to generate the second display data, the second display data configured to cause a second image to be displayed in the second area, irrespective of external input image signal.

The second image may be a predetermined image of a gray scale image.

The gray scale image may be substantially black.

The image signal generating unit may be configured to generate the second image data based on a part of the first image signal, which corresponds to outermost pixels of the first area.

The second image data may be generated by copying a part of first image signal corresponding to the outermost pixels of the first area.

The second area may extend from the first area and extends in at least one of the first and second directions.

The display-position information may include off-set information from a normal area, wherein the normal area is a central area in the display area.

The display-position information may include at least a position of one corner of the first display area.

The display device may further include at least a first display panel and a second display panel stacked on each other. The display area may be formed in one of the first display panel and the second display panel.

The first display panel may displays in monotone, the second display panel may display in color, and the display area may be formed in the first display panel.

The second display panel may include a display portion. The display portion may be configured to display the image based on the external input image data. The display area may overlap the display portion in plan view. The display area may be larger than the display portion.

The first display area may have a same area as the display portion.

The image signal generating unit may be configured to generate the second image data based on at least a part of the first image signal corresponding to the outermost pixels of the first area.

The first display panel may displays in monotone, the second display panel may display in color, and the display area may be formed in the second display panel.

The first display panel may include a display portion, the display portion configured to display the image based on the external input image data. The display area may overlap the display portion in a plan view. The display area may be larger than the display portion.

The first display area may be a same area as the display portion.

The image signal generating unit may be configured to generate the second image data to display a substantially black image in the second area.

The first display panel may display in monotone, the second display panel may display in color. The display area may be formed in each of the first and second display panels.

The first display area in the first display panel may be a same area as the first display area in the second display panel.

The image signal generating unit may be configured to: generate the second image data for the first display panel so as to display a substantially black image in the second area, and to generate the second image data for the second display panel based on at least a part of the first image signal corresponding to the outermost pixels of the first area.

The display device may further include a positional change unit, wherein the positional change unit is configured to rewrite the display-position information stored in the memory unit. The positional change unit can be implemented by a positional change circuit.

BRIEF DESCRIPTION OF DRAWINGS

As shown in FIG. 2;

DETAILED DESCRIPTION OF THE PREFERRED EMBODIMENTS

First Exemplary Embodiment

An embodiment of the present disclosure is described below with reference to the accompanying drawings. In the embodiment of the present disclosure, a liquid crystal display device is taken as an example, but a display device according to the present disclosure is not limited to the liquid crystal display device, and may be, for example, an organic EL display device.

Figure 1:
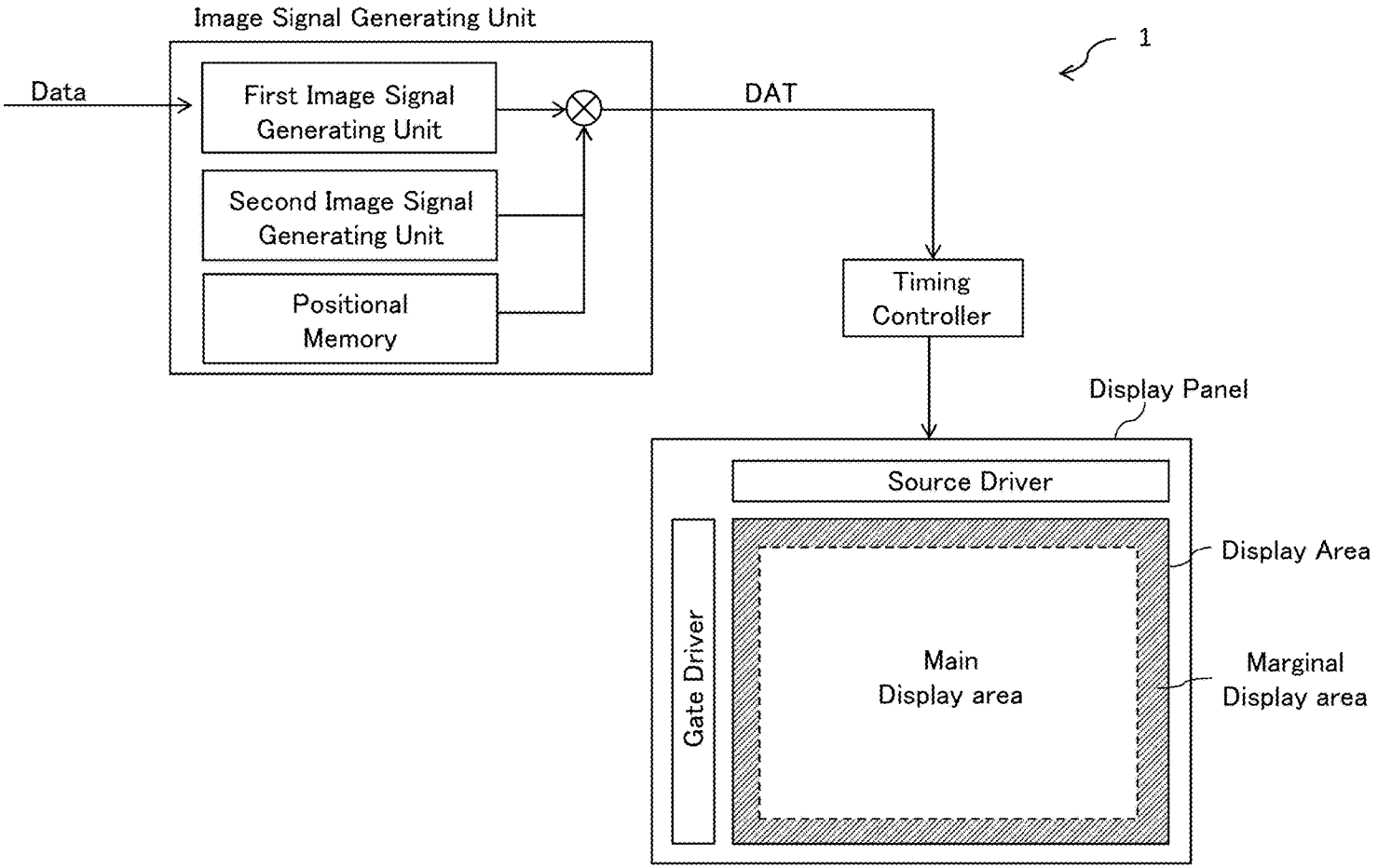
FIG. 1 is a view illustrating a schematic configuration of a liquid crystal display device according to a first embodiment.

FIG. 1 is a view illustrating a schematic configuration of a liquid crystal display device 1 according to the first embodiment. The liquid crystal display device 1 includes a display panel that displays an image in a display area, driving circuits (source driver, gate driver) that drives display panel, a timing controller that controls the driving circuits, an image signal generating unit that performs image processing on external input image datas Data and outputs image data DAT to the timing controller, and a backlight (not illustrated) that irradiates the display panel with light from a rear surface side. The driving circuit may be mounted on display panel.

The image signal generating unit includes a first image signal generating unit, a second image signal generating unit, and a positional memory. The first image signal generating unit generates a first image signal based on the external input image data Data. The first image signal is used so as to display a main image in a part of the display area, which is a main display area. The external input image data Data includes luminescence data and color data for pixels located in the main display area. The display area is larger size than the main display area. An area other than the main display area in the display area is a marginal display area. The second image signal generating unit generates a second image signal for displaying a marginal image in the marginal display area. A way to generate the second image signal will be described later in details. The image signal generating unit has the positional memory which stores display-position information. The display-position information indicates a location where the main image is displayed within the display area. The image signal generating unit generates the image signal by combining the first display signal and the second display signal with the display-position information.

The image signal generating unit outputs the image signal to the timing controller. The timing controller controls driving circuits so as to display the main image in a main display area and the marginal image in a marginal display area according to the display-position information stored in the positional memory.

Figure 2:
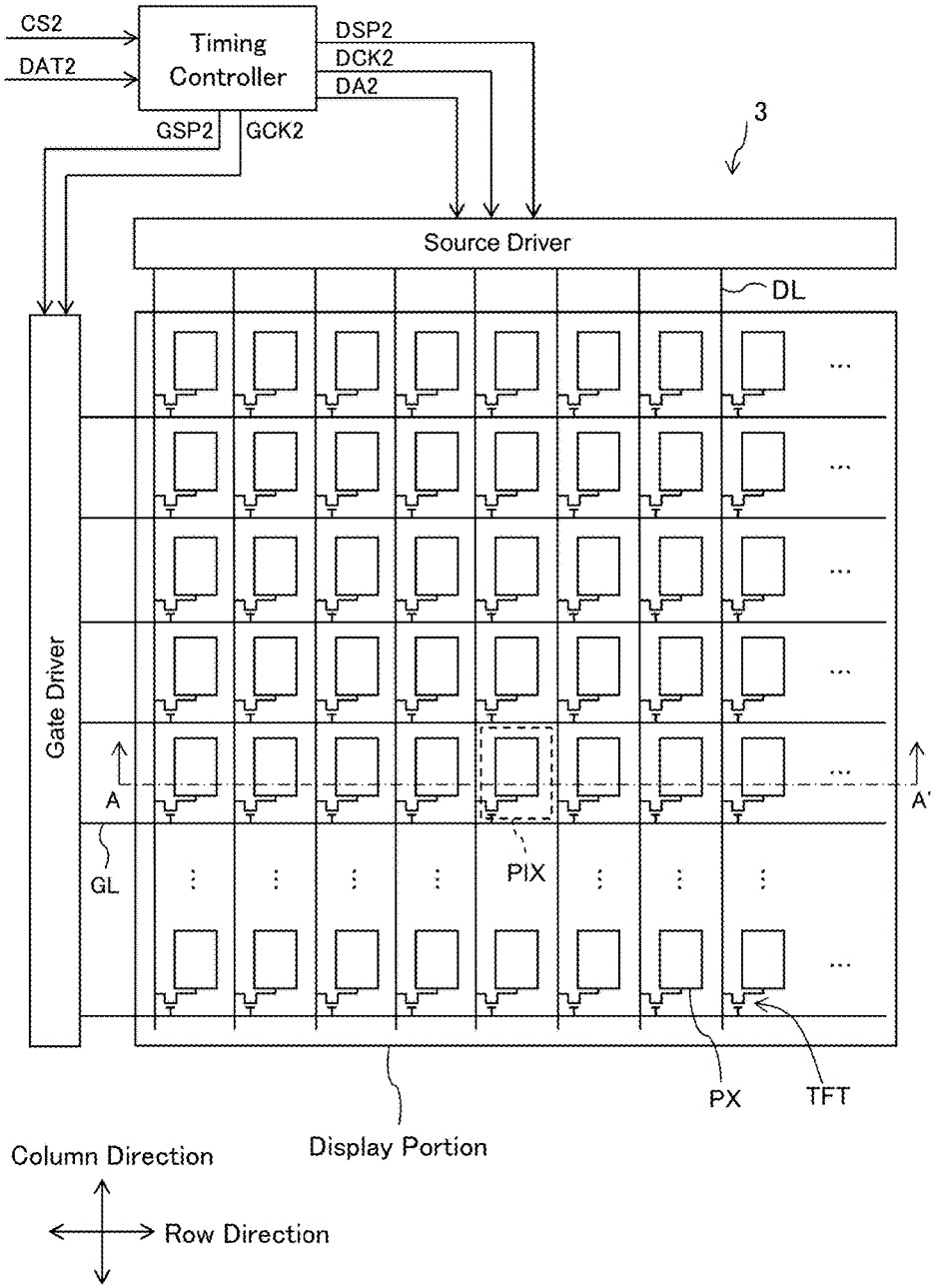
FIG. 2 is a view illustrating a schematic configuration of a liquid crystal display panel according to the first embodiment.

FIG. 2 is a view illustrating a schematic configuration of a liquid crystal display panel 3 according to the first embodiment. The liquid crystal display panel 3 includes a thin film transistor (hereinafter, referred to as a TFT) substrate. As illustrated in FIG. 2, a plurality of data lines DL extending in a first direction (for example, a column direction) and a plurality of gate lines GL extending in a second direction (for example, a row direction) different from the first direction are formed in a TFT substrate, each TFT is formed in an area of each of the intersections of the plurality of data lines DL and the plurality of gate lines GL. A rectangular area surrounded by two adjacent data lines and two adjacent gate lines is defined as one pixel PIX. A plurality of pixels PIX is arranged in a matrix form (the row direction and the column direction). The plurality of data lines DL are arranged at approximately equal intervals in the row direction, and the plurality of gate lines GL are arranged at approximately equal intervals in the column direction. A pixel electrode PX is provided in each pixel. Each pixel electrode includes an opening (for example, a slit), and is formed into a stripe shape. One common electrode (not illustrated) common to each pixel is formed in the TFT substrate.

A data signal (data voltage) is supplied from a source driver to each data line DL, and a gate signal (gate voltage) is supplied from a gate driver to each gate line GL. Common voltage Vcom is supplied to the common electrode. When an on voltage of the gate signal (gate-on voltage) is supplied to gate line GL, a TFT connected to gate line GL is turned on to supply the data voltage to pixel electrode PX through the data line DL connected to the TFT. An electric field is generated by a difference between the data voltage supplied to pixel electrode and the common voltage Vcom supplied to common electrode. The liquid crystal is driven by the electric field which controls the transmittance of the light transmitted from the backlight, thereby displaying an image. The desired data voltages are supplied to data lines connected to pixel electrodes PX of the pixels PIX, thereby displaying an image.

The timing controller performs known image processing. For example, based on the image signal generated by the first image signal generating unit and control signal (a clock signal CS, a vertical synchronizing signal, and a horizontal synchronizing signal, for example), the timing controller can generate various timing signals (data start pulse DSP, data clock DCK, gate start pulse GSP, and gate clock GCK, for example) controlling the driving voltage of the source driver and the gate driver and image data configured to be input into the source driver.

Figure 3:
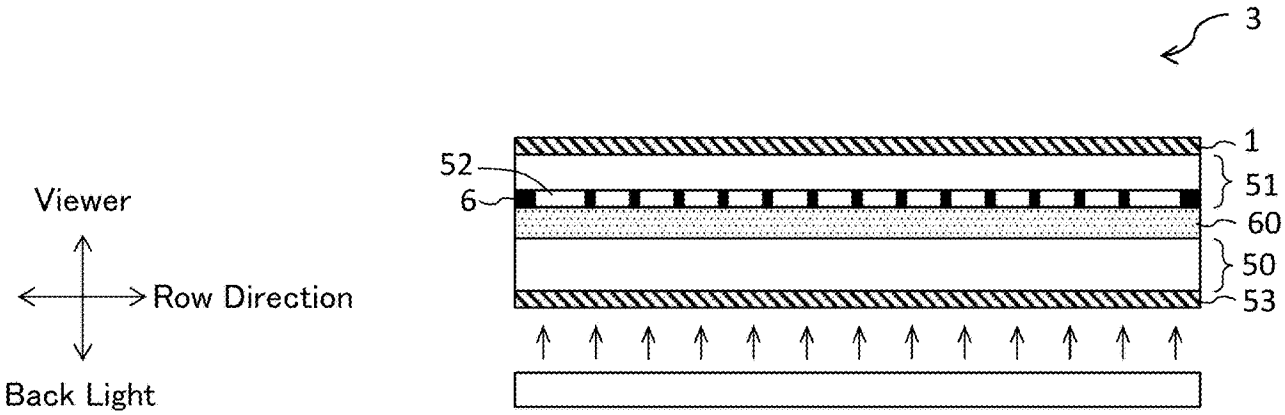
FIG. 3 is a cross-sectional view taken along line A-A' in FIG. 2.

FIG. 3 is a cross-sectional view taken along line A-A' in FIG. 2. As shown in FIG. 2, the display panel 3 includes the TFT substrate 50 disposed on the backlight side, the counter substrate 51 opposing the TFT substrate 50 and disposed on the viewer side (display surface-side), and a liquid crystal layer 60 sandwiched between the TFT substrate 50 and the counter substrate 51. A polarizer 53 is arranged on the backlight side of the display panel 3 and the other polarizer is arranged on the viewer side of the display panel 13. The counter substrate shown in FIG. 4 does not include a plurality of color filters. Thus, the liquid crystal display device 1 of the first embodiment does not display in color, but instead displays in monotone. However, the present disclosure is not limited to this embodiment. The counter substrate may include a color filter 52, and the liquid crystal display device 1 may display a color image.

Figure 4:
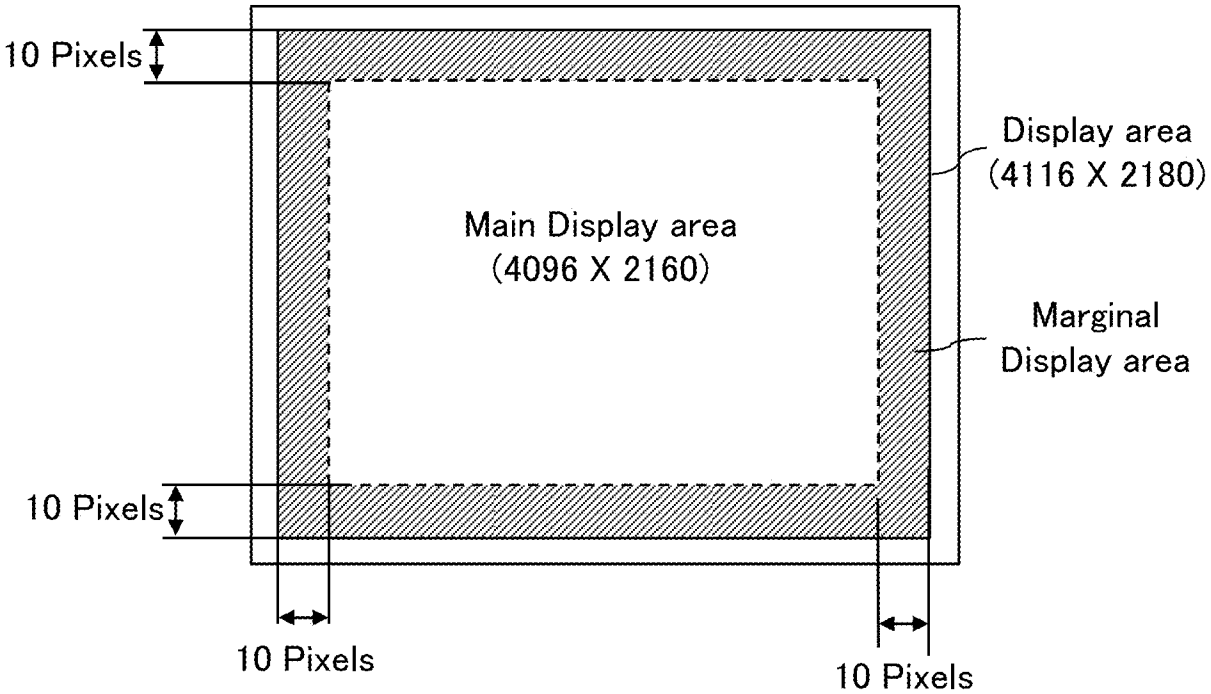
FIG. 4 is a schematic plan view of the display area according to the first exemplary embodiment.

FIG. 4 is a schematic plan view of the display area according to the first exemplary embodiment. In this embodiment, 4116 pixels in the row direction and 2180 pixels in the column direction are arranged in matrix in the display area. The external input image data Data is supplied based on DCI 4K, also referred to as so called, 4K×2K, and defines a resolution of 4096 pixels in the row direction and 2160 pixels in the column direction. Therefore, pixels in the display area have a greater number of pixels included in the external input image data Data. The positional memory stores the display-position information which indicates a location where the main image is displayed within the display area. The first image signal generating unit generates the first signal based on the external input image data Data. The external input image data Data includes at least luminescence data and color data for each pixel. Because any color filter is not formed in the counter substrate 51, the liquid crystal display device 1 of this embodiment does not display color. Thus, the first image signal generating unit generates the first signal for the monotonic display by a known method. For example, maximum luminescence among red, green and blue pixels is utilized so as to generate the first image signal for the monotonic display. The first image signal has image data with a resolution of 4096 pixels in the row direction and 2160 pixels in the column direction. In a normal state, the positional memory stores no off-set of the display-position information. In this case, the image signal generating unit generates the image signal such that a main image based on the first signal is set to be positioned in a central display area of a whole display area. The central display area can be an area defined by 4 corner pixels, a pixel (11, 11), a pixel (4106, 11), a pixel (11, 2170) and a pixel (4106, 2170). Here, a pixel (X, Y) indicates a position of the pixel, and the pixel is located in X-th from the left edge and Y-th from the top edge. In other words, the pixel (X,Y) is connected to the X-th data line from the left edge and to the X-th gate line from the top edge. A marginal display area, which is outside of the main display area in the display area, is symmetrically shaped.

The marginal display area corresponds to pixels connected to 10 data lines in the left side of the main display area and the right side of the main display area, and pixels connected to 10 gate lines in both the top side of the main display area and the bottom side of the main display area. The second image single generating unit generates a second image signal and a marginal image is displayed in the marginal display area according to the second image signal. A way to generate the second image signal will be described later.

Figure 5:
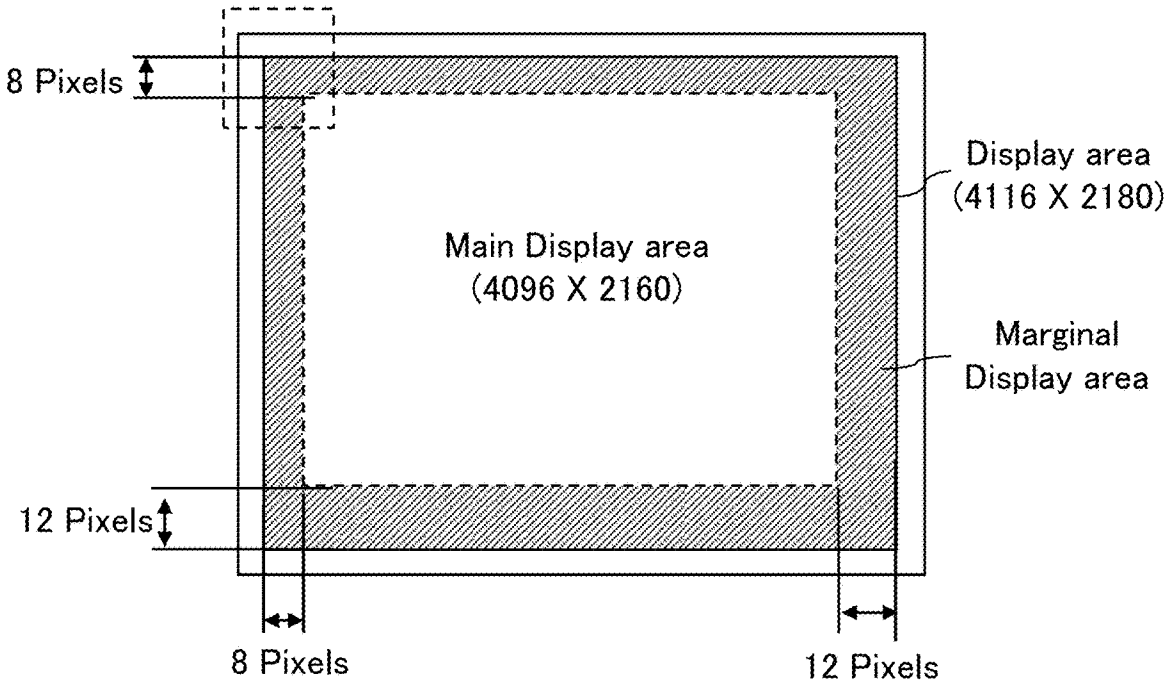
FIG. 5 is another example of schematic plan view of the display area according to the first exemplary embodiment.

FIG. 5 is another example of schematic plan view of the display area. In an off-set state, the positional memory stores the display-position information of how much off-set is required. For example, the positional memory stores the display-position information which indicates two data lines shifted left and two gate lines shifted up from the central display area. In this case, the image signal generating unit generates the image signal such that a first image based on the first signal displays in an area from pixel (9, 9) to pixel (4104, 9) in the row direction and pixel (9, 9) to pixel (9, 2168) in the column direction. The display-position information may indicate at least one corner of the main display area. For example, a top-left corner of the main display area is pixel (9, 9). When the display-position information includes at least one corner of the main display area, a whole of the main display area is automatically fixed.

Figure 6:
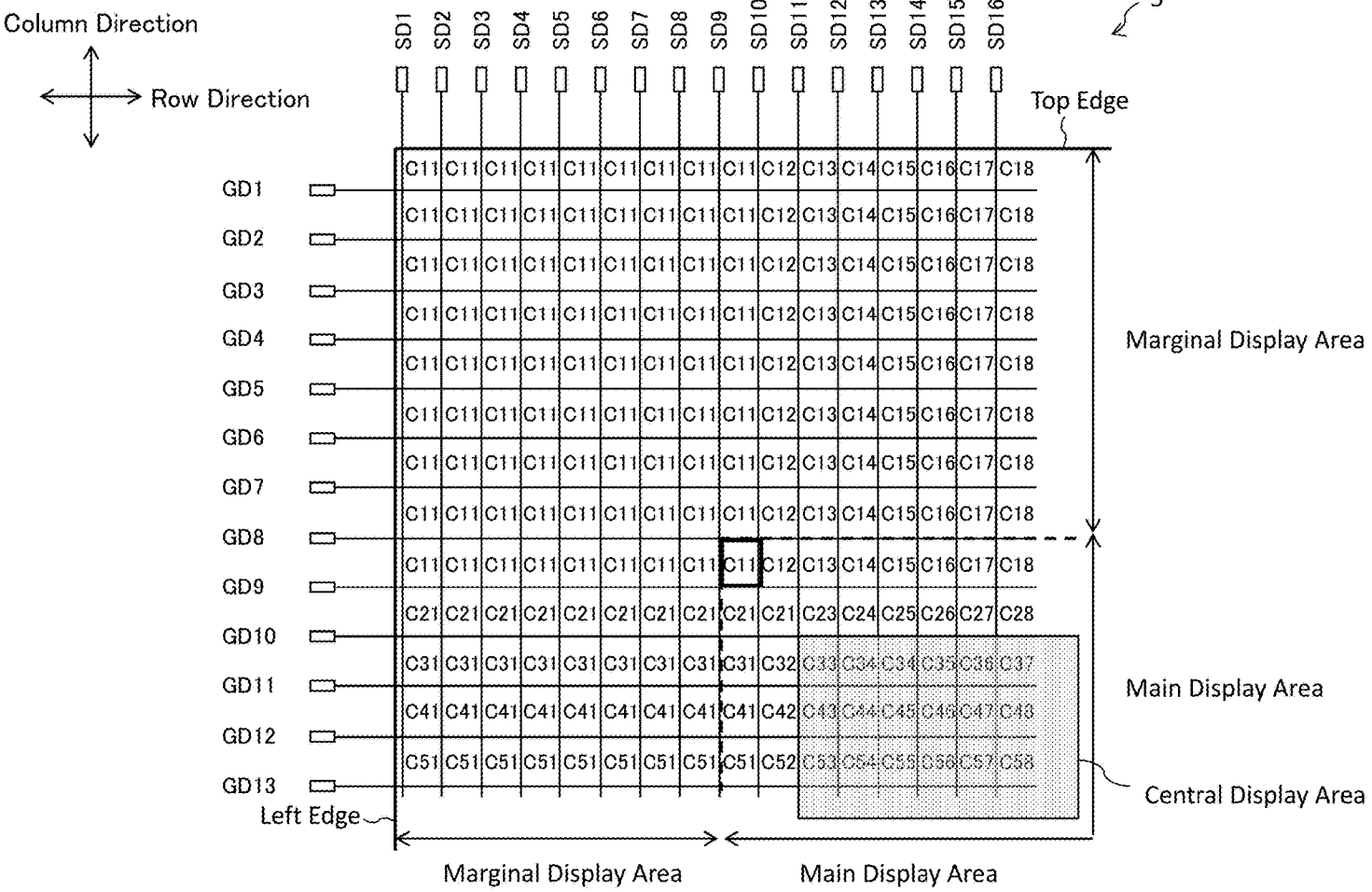
FIG. 6 is an enlarged view of a part of the display area indicated by a square of a dot line in FIG. 5.

FIG. 6 is an enlarged view of a part of the display area indicated by a square of a dot line in FIG. 5. The way to generate the second image signal is described in FIG. 6. In FIG. 6, "SD1"~"SD16" indicate 1st to 16th output terminals of the source driver and "GD1"~"GD13" indicate 1st to 13th output terminals of the gate driver.

FIG. 6 illustrates the first image displayed in the main display area and a marginal image displayed in the marginal display area. As already described above, a pixel in one corner of the main display area connects with a 9th data line which connects with an output terminal SD9 of the source driver and a 9th gate line which connects with an output terminal GD9 of the gate driver. The main display area is off-set from the central display area by two pixels to the left and two pixels up. The amount of off-set, that is the display-position information, is stored in the positional memory. And the external input image data includes image data for all pixels in the fourth display area.

According to the display-position information and pixel information included in the first image signal, a position of the main display is fixed. Image voltage according to the first display signal is written to pixels in the main display area, whereby the main image is displayed in the main display area. The same image voltage written to a pixel in an edge of the main display area is written to pixels in the marginal display area. For example, pixels located within a region from pixel (1, 1) to pixel (9, 1) in the row direction and pixels from pixel (1, 1) to pixel (1, 9) in the column direction display the same luminescence, because the second image signal generating unit generates the second display signal so as to copy the first display signal corresponding to pixel (9,9) in the main display area to the other pixels in the marginal display area. Pixels in the marginal display area, which are on the left side of the main display area, display the same luminescence as the pixel on the left edge of the main display area. For example, the main display signal corresponding to pixel (9,10) in the main display area is copied to the second display signal corresponding to each of pixels (1,10)≈(8,10). In the same manner, pixels in the marginal display area, which are located above the main display area, display the same luminescence as the pixel in the top edge of the main display area. For example, the first display signal corresponding to pixel (10,9) in the main display area is copied to the marginal display signal corresponding to each of pixels (10,1)~(10,8). This way generating a second image signal is done by copying of a part of the first image signal. This technique is not limited to this embodiment. The second image signal generating unit may perform a smoothing process on the second image signal so as to make a boundary between the main and marginal display areas inconspicuous. For example, the second image signal generating unit may generate the second image signal based on the first image signal corresponding to pixels on the edge of the main display area as well as pixels inside the main display area. The second display signal corresponding to each of pixels (1,10)≈(8,10) is generated based on the first display signal corresponding to not only pixel (9,10) but also to pixel (10,10) in the main display area. When the second image signal generating unit generates the second image signal based on at least the first image signal corresponding to pixels on the edge of the main display area, it is within a scope of this embodiment.

Figure 7:
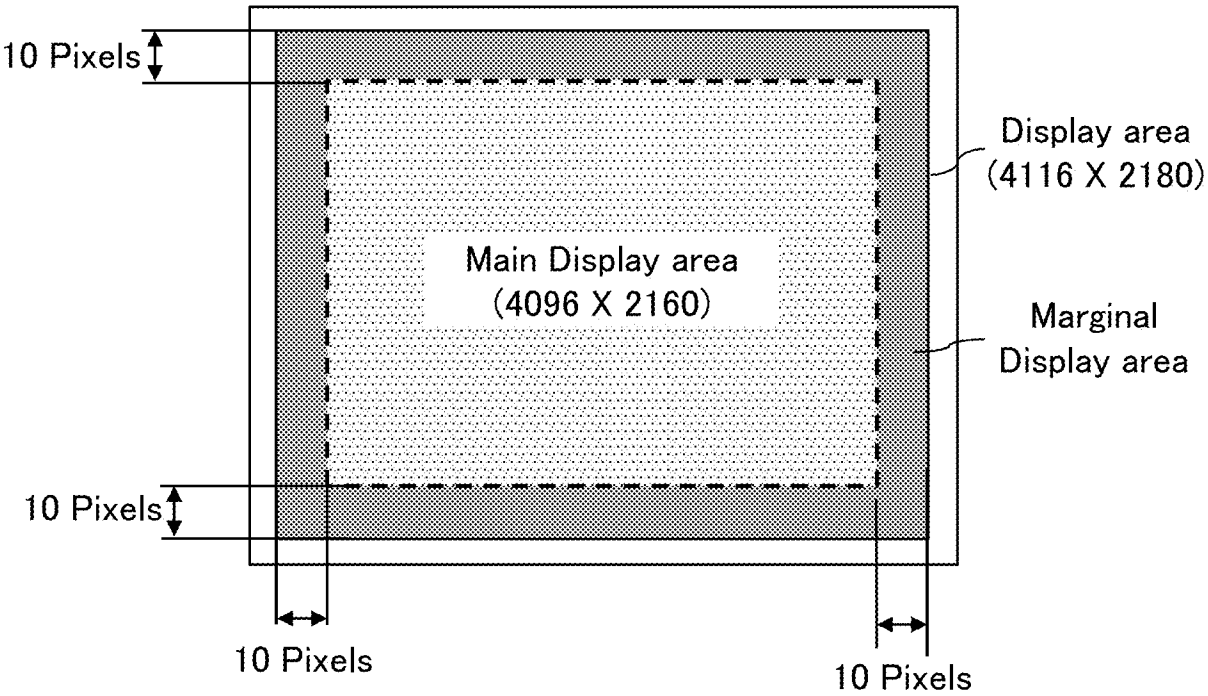
FIG. 7 shows another example of the first image displayed in the main display area and the second image displayed in the marginal display area.

FIG. 7 shows another example of the first image displayed in the main display area and the second image displayed in the marginal display area. In the previous example, when the second image signal generating unit generates the second image signal, the first image signal is utilized. This is not limited to this embodiment. In this example, the second image signal generating unit generates the second image signal so as to display a gray scale image, such as a black image, in the marginal display area. In this case, the second image signal is generated, irrespective of the first image signal. In this example, an image according to the external input image data is displayed in the main display area and the black image is displayed in the marginal display area, surrounding the main display area. A boundary between the main and marginal display areas is able to be made clearer.

Figure 8:
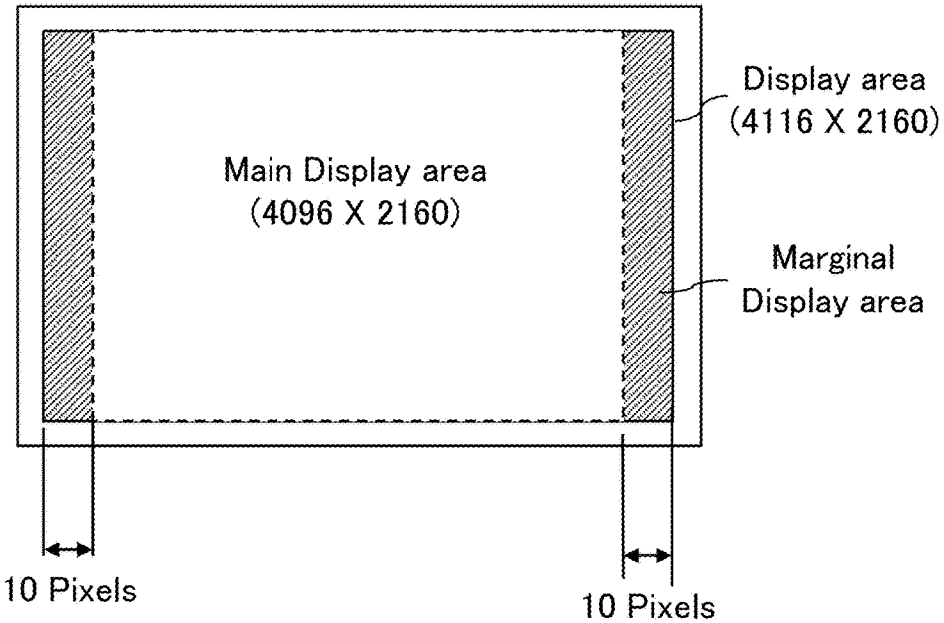
FIG. 8 is another example of schematic plan view of the display area according to the first exemplary embodiment.
Figure 9:
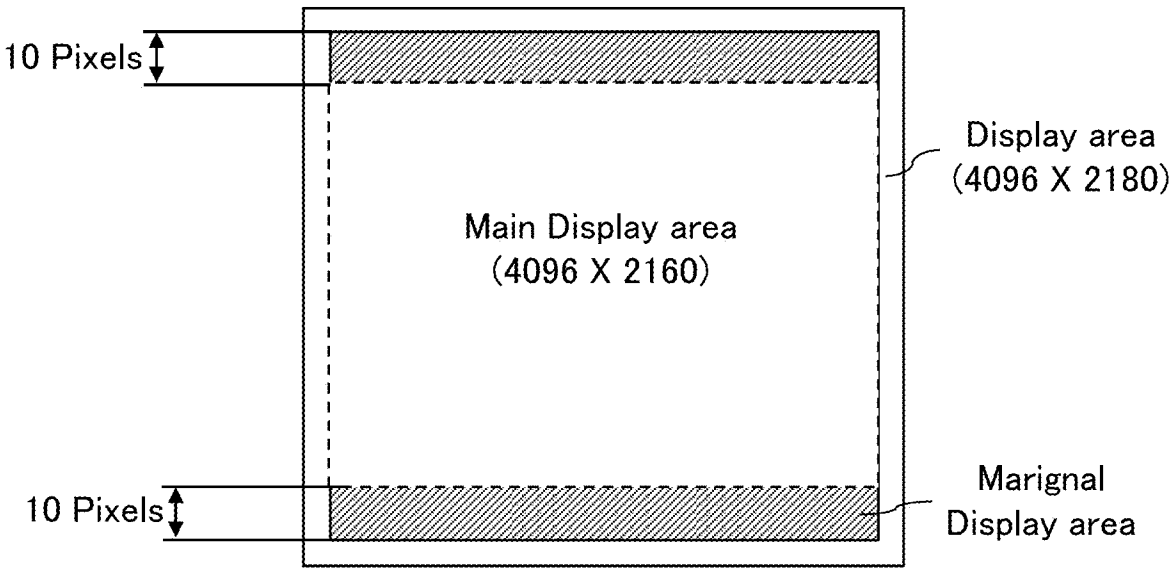
FIG. 9 is another example of schematic plan view of the display area according to the first exemplary embodiment.

In examples described with FIGS. 4 to 7, the marginal display area is extended from the main display area in both the column and row directions, which is not limited to the first embodiment. In FIG. 8, marginal display areas are located in both the left and right sides of the display area. The marginal display area is present in neither top nor bottom side of the main display area. In this example, a black image is displayed in the marginal display area. As an opposite example, in FIG. 9, marginal display areas are located in both top and bottom sides of the main display area. The marginal display area is present in neither right nor left sides of the main display area.

The display-position information may be rewritable. The main display area can be changed within the display area. In the above example, the top-left corner of the main display area can change from pixel (1, 1) to pixel (20, 1) in the row direction and from pixel (1, 1) to pixel (1, 20) in the column direction. For example, a user can change the position of the main display area with a switch, which can be realized by rewriting the display-position information stored in the positional memory.

According to the first embodiment, a display position of the main image can be changed within the display area. And the display area surrounding the main display area displays the second image, which can be made based on the external input image data, or can be made irrespective of the external input image data.

Second Exemplary Embodiment

A second exemplary embodiment of the present disclosure will be described below with reference to the drawings. For convenience, the components having the same functions as those of the first exemplary embodiment are designated by the same reference marks, and their description is omitted.

A liquid crystal display device 5 according to the second embodiment includes a plurality of display panels for displaying images, a plurality of drive circuits (a plurality of source drive, a plurality of gate drivers, for example) for driving the respective display panels, and a plurality of timing controllers controlling each of the drive circuits, an image signal generating unit which performs image processing on an external input image data and outputs image data to each timing controller, and a backlight (not shown in FIG. 10) to illuminate light on the plurality of display panels from the back side. The number of display panels is not limited and may be two or more. In addition, the plurality of display panels are arranged so as to overlap each other in the front-rear direction when viewed from the viewer side. The plurality of display panels are arranged to each display an image. Hereinafter, a liquid crystal display device having two display panels will be described as an example.

Figure 10:
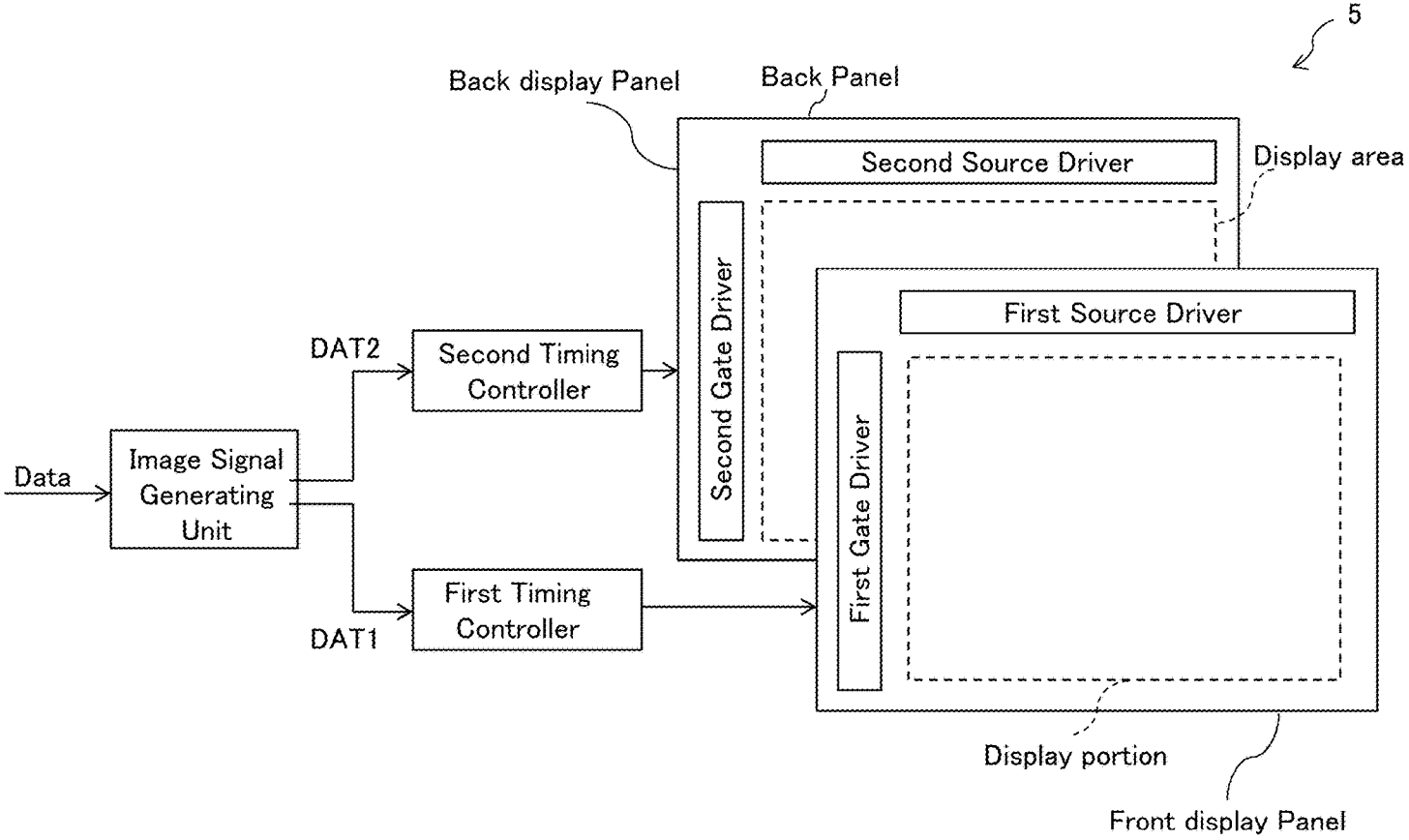
FIG. 10 is a plan view showing a schematic configuration of a liquid crystal display device according to a second embodiment.
Figure 11:
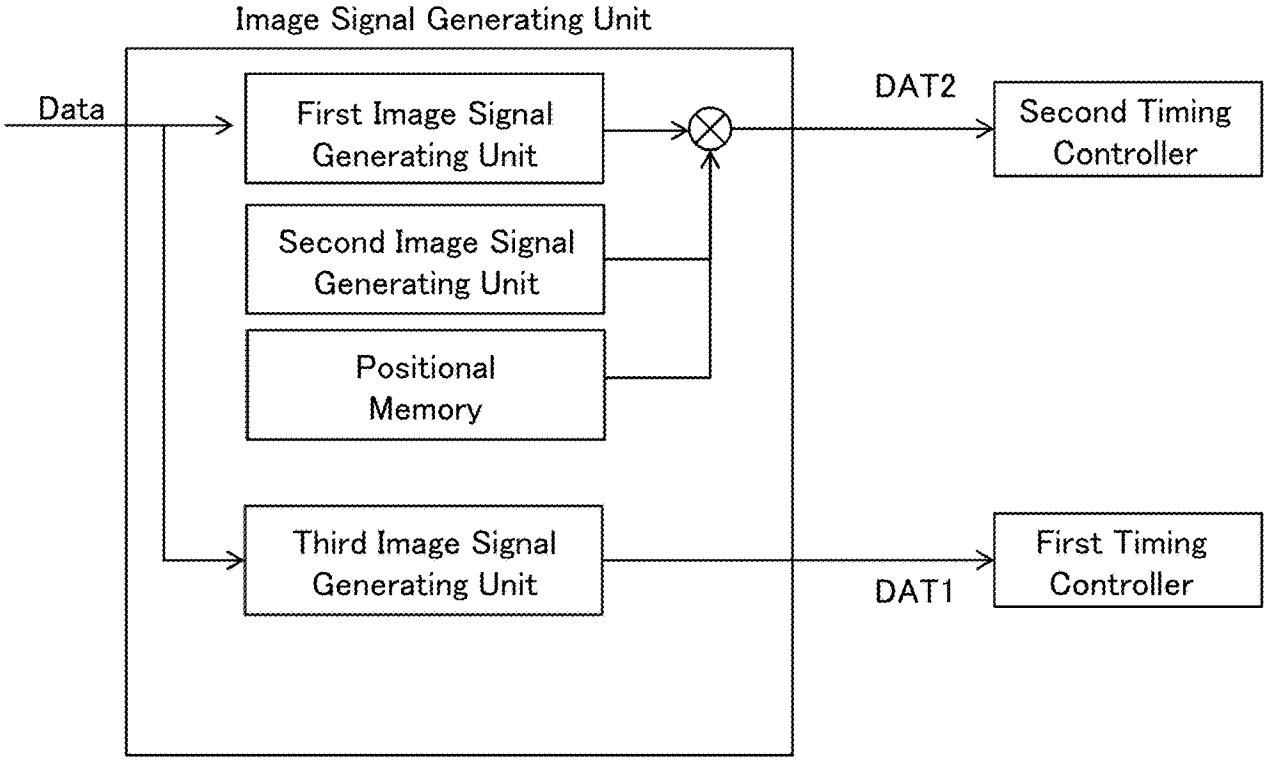
FIG. 11 is a block diagram of the image signal generating unit according to the second embodiment.

FIG. 10 is a plan view showing a schematic configuration of a liquid crystal display device according to this embodiment. As shown in FIG. 10, the liquid crystal display device 5 includes a front display panel arranged at a position close to the viewer (front side) and a back display panel arranged at a position farther from the viewer (rear side) than the front display panel. The front display panel receives various timing signals from a first timing controller for controlling a first source driver and a front gate driver. The back display panel receives various timing signals from a back timing controller for controlling a second source driver and a back gate driver. An image signal generating unit outputs a first image data to the first timing controller and outputs a second image data to the second timing controller. The first timing controller can be implemented by a control circuit. The second timing controller can be implemented by a control circuit. The front display panel displays a color image according to the external input image data Data, and the back display panel displays a black and white (monotonic) image according to the external input image data Data. FIG. 11 is a block diagram of the image signal generating unit. The image signal generating unit includes a first image signal generating unit, a second image signal generating unit, a positional memory and a third image signal generating unit. The first image signal generating unit, the second image signal generating unit and the third image signal generating unit can be implemented by individual image signal generating circuits, or a single image signal generating circuit. The first image signal generating unit performs image processing so as to increase contrast in luminescence and suppress the adverse effects of moire fringes and oblique parallax by for example, a maximum value filter and/or an average value filter. The first image signal generating unit performs the same image processing as that in the first embodiment. The second image signal generating unit generates a marginal image signal in the same manner as that in the first embodiment.

The image signal generating unit generates an image data by combining the first image signal and the second image signal with display-position information stored in the positional memory. The third image signal generating unit generates the first image signal based on the external input image data Data so as to display a color image in a display portion. The external input image data Data includes image data to display color and luminescence in each pixel in the display portion of the front display panel. For example, 4096 pixels in the row direction and 2160 pixels in the column direction are arranged in a matrix in the display portion of the front display panel. All the pixels are driven by each independent image data corresponding to each pixel according to the external input image data Data. On the other hand, 4116 pixels in the row direction and 2180 pixels in the column direction are arranged in a matrix in the display area of the back display panel, which is more than the number of pixels corresponding to the external input image data Data. Thus, the display area in the back display panel is larger than the display portion in the front display panel. A main display area in the back display panel overlaps the display portion in the front display panel in a plan view. A marginal area surrounds the main display area. A main image is displayed in the main display area according to the main image display signal. A marginal image is displayed in the marginal display area according to the marginal image display signal. In this embodiment, the marginal display signal is generated based on the main display signal corresponding to pixels on the edge of the main display area, as previously described in the first embodiment.

The front display panel and the back display panel are stacked adjacent to each other such that a central display area in the back display panel matches with the display portion in the front display panel. In this case, there are 20 more pixels in the display area of the back display panel that are arranged in the column direction, than the display portion of the front display panel. And there are 20 more pixels in the display area of the back display panel that are arranged in the row direction, than the display portion of the main display panel. Thus, the central display area in the back display panel corresponds to an area from pixel (11, 11) to pixel (4106, 11) in the row direction and pixel (11, 11) to pixel (11, 2170) in the column direction.

However, it is almost impossible to match the central display area of the back display panel with the display portion of the front display panel without any off-set, in a liquid crystal display device. Or it may require a high investment for a manufacturing machine to prevent the off-set.

According to this embodiment, after the front and back display panels are stacked adjacent to each other, an off-set is measured between the central display area in the back display panel and the display portion in the front display panel. The off-set that has occurred, that is display-position information, is stored in the positional memory. Then the main display image is displayed in the main display area of the back display panel which overlaps the display portion of the front display panel.

Figure 12:
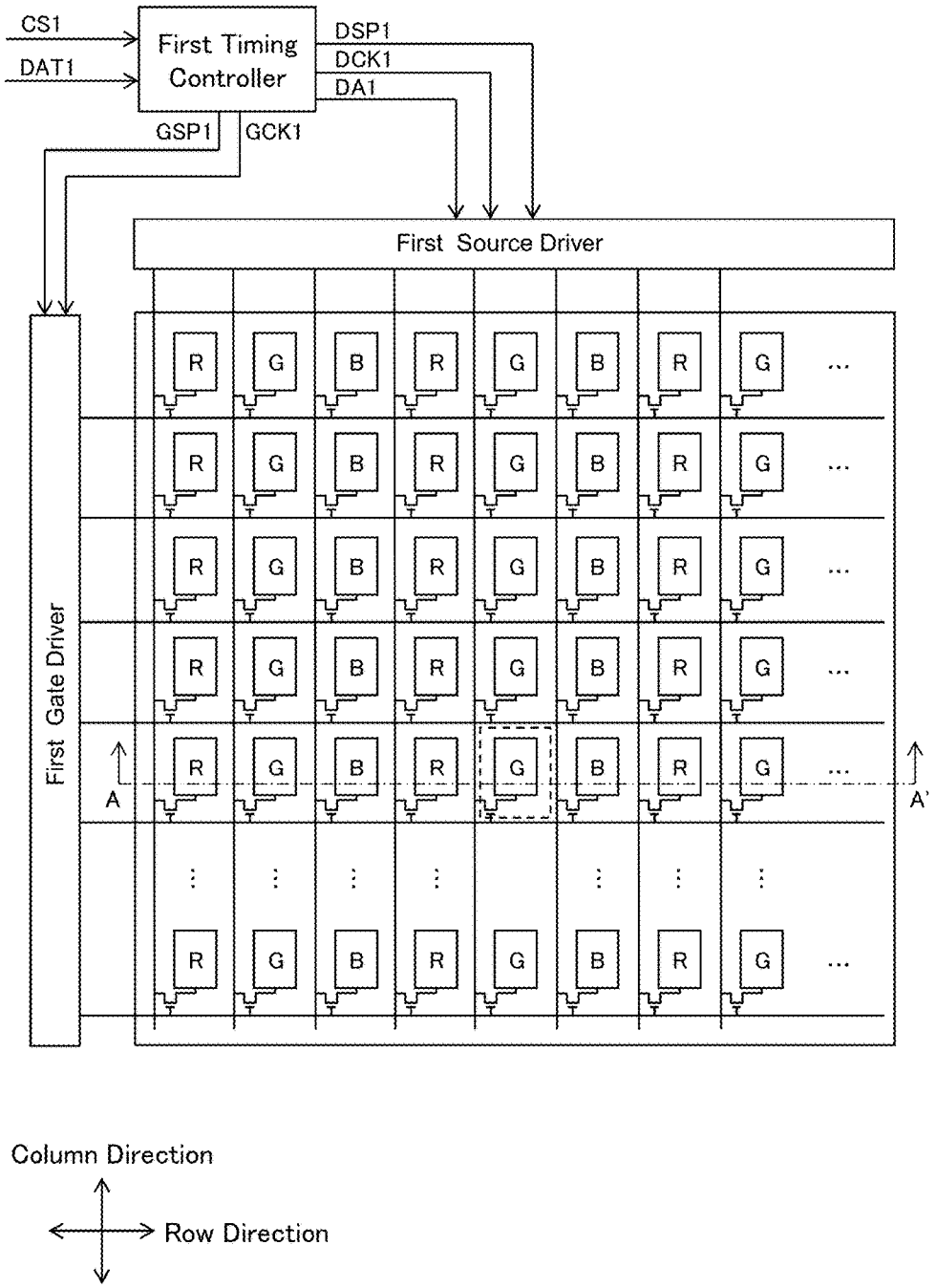
FIG. 12 is a plan view showing a schematic configuration of a front display panel according to the second embodiment.
Figure 13:
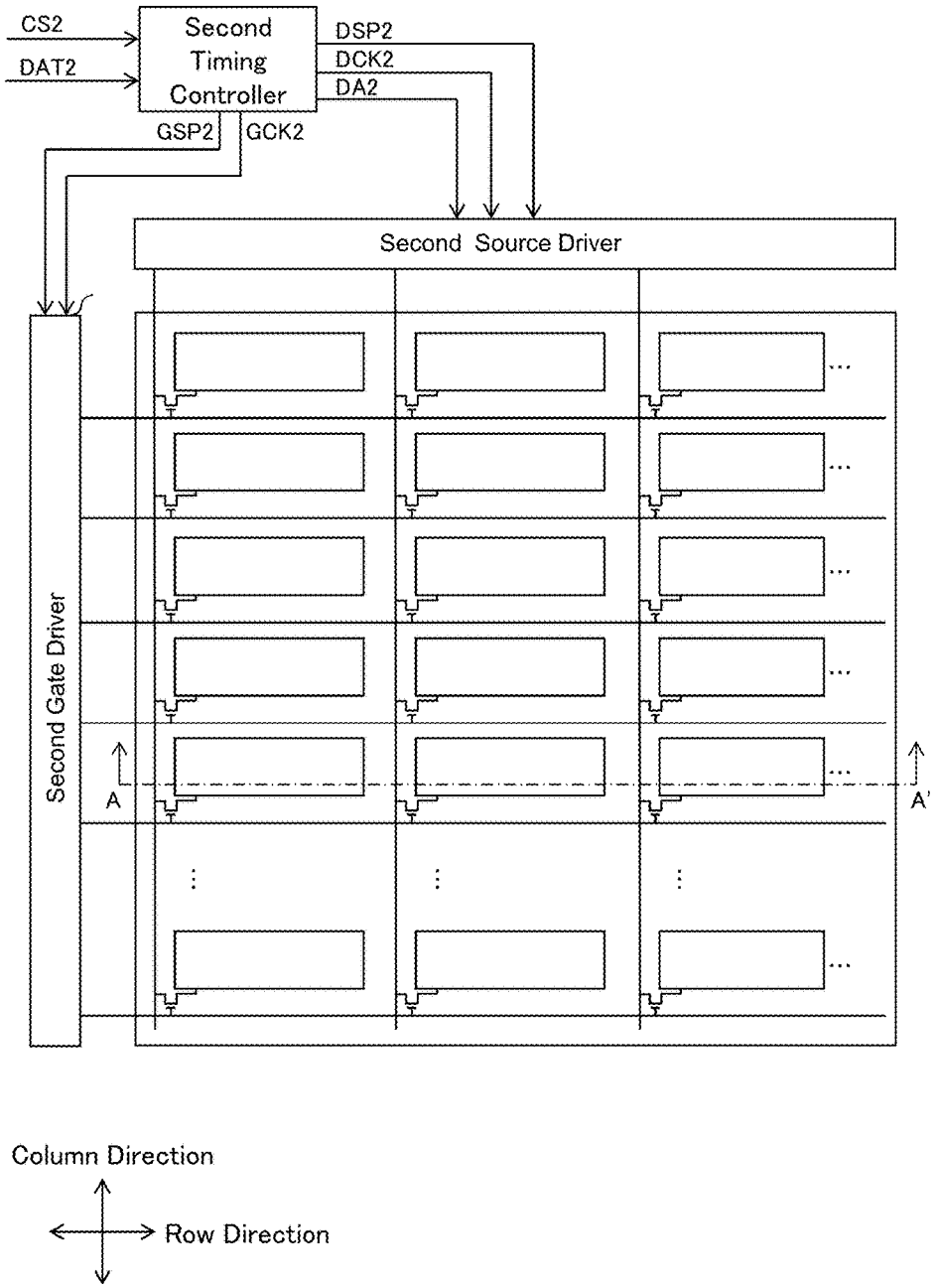
FIG. 13 is a plan view showing a schematic configuration of a back display panel according to the second embodiment.
Figure 14:
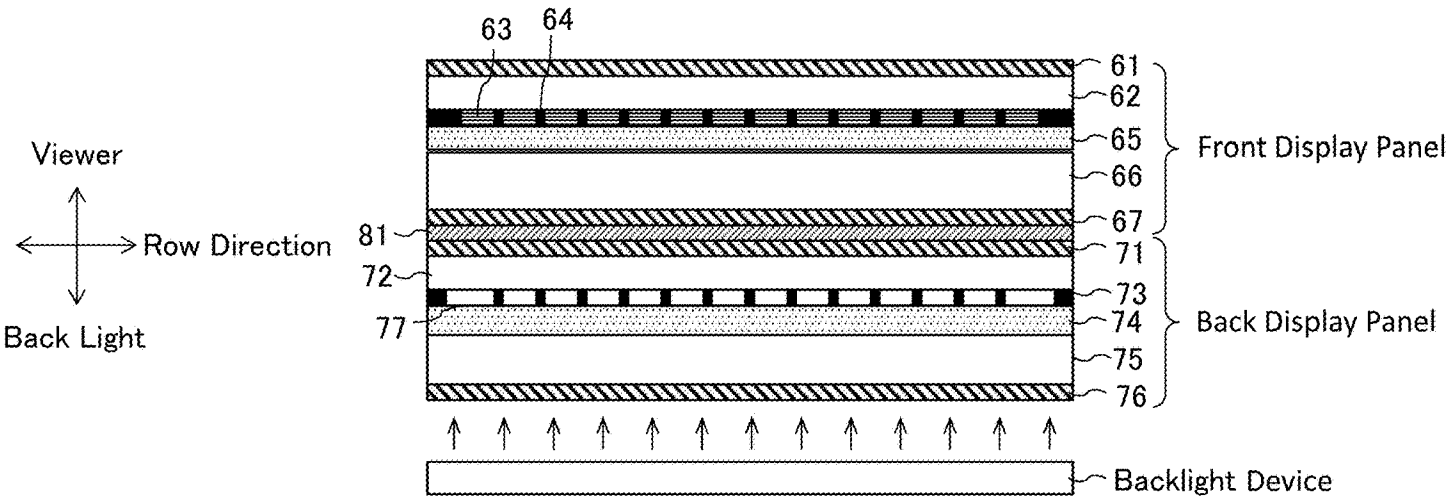
FIG. 14 is a sectional view taken along the line AA' of FIGS. 12 and 13.

FIG. 12 is a plan view showing a schematic configuration of a front display panel. FIG. 13 is a plan view showing a schematic configuration of a back display panel. FIG. 14 is a sectional view taken along the line AA' of FIGS. 12 and 13.

The configuration of the front display panel will be described with reference to FIGS. 12 and 14. The front display panel includes a TFT substrate 66 disposed on the backlight side, a color filter substrate 62 (hereinafter referred to as a CF substrate) disposed on the viewer side and facing the TFT substrate 66. A liquid crystal layer 65 is disposed between the TFT substrate 66 and the CF substrate 62. A polarizing plate 67 is disposed on the backlight side of the front display panel, and a polarizing plate 61 is disposed on the viewer side.

As shown in FIG. 14, on the CF substrate, a plurality of colored portions 63 are formed corresponding to each pixel. Each colored portion 63 is surrounded by a black matrix 64 that blocks transmission of light, and is formed in, for example, a rectangular shape. In addition, the plurality of colored portions 63 includes a red portion formed of a red (R) material that transmits red light, a green portion formed of a green (G) material that transmits green light, and a blue portion formed of a blue (B) material that transmits blue light. The red portion, the green portion, and the blue portion are repeatedly arranged in this order in the row direction, colored portions of the same color are arranged in the column direction, and a black matrix 64 is formed at the boundary portion between the colored portions 63 adjacent in the row direction and the column direction, as shown in FIG. 14. The plurality of pixels includes a red pixel corresponding to a red portion, a green pixel corresponding to a green portion, and a blue pixel corresponding to a blue portion. Therefore, the front display panel can display in color.

Next, the configuration of the back display panel will be described with reference to FIGS. 13 and 14. As shown in FIG. 14, the back display panel includes a TFT substrate 75 arranged on the backlight side, a counter substrate 72 arranged on the viewer side, opposed to the TFT substrate 75. A liquid crystal layer 74 is sandwiched between the TFT substrate 75 and the counter substrate 72. And a polarizing plate 76 is disposed on the backlight side of the back display panel, and another polarizing plate 71 is disposed on the viewer side of the back display panel. A diffusion sheet 81 is disposed between the polarizing plate 67 of the front display panel and the polarizing plate 71 of the back display panel.

As shown in FIG. 14, on the counter substrate 72, at a position corresponding to the boundary portion of each pixel, a black matrix 73 for blocking the transmission of light is formed. In the area surrounded by the black matrix 73, no colored portion is formed. For example, an overcoat film 77 is formed therein. Thus, the back display panel does not display in color, but displays in black and white (monotone).

The configuration of the back display panel is similar to the display panel in the first embodiment, except for a pixel size. External input image data Data for one pixel includes luminescence and colors of red, green, and blue. Based on the information for one pixel, one pixel consisting of three sub-pixels, a red sub-pixel, a green sub-pixel and a blue sub-pixel is driven. In the back display panel, no color filter is formed, and one pixel defined by two adjacent data lines and two adjacent gate lines is driven based on the external input image data Data for one pixel. Thus, one pixel consisting of three sub-pixels formed in the front display panel corresponds to and overlaps in a plan view with one pixel formed in the back display panel. A size of one pixel of the back display panel is nearly the same size as one pixel of the three sub-pixels of the front display panel.

Figure 15:
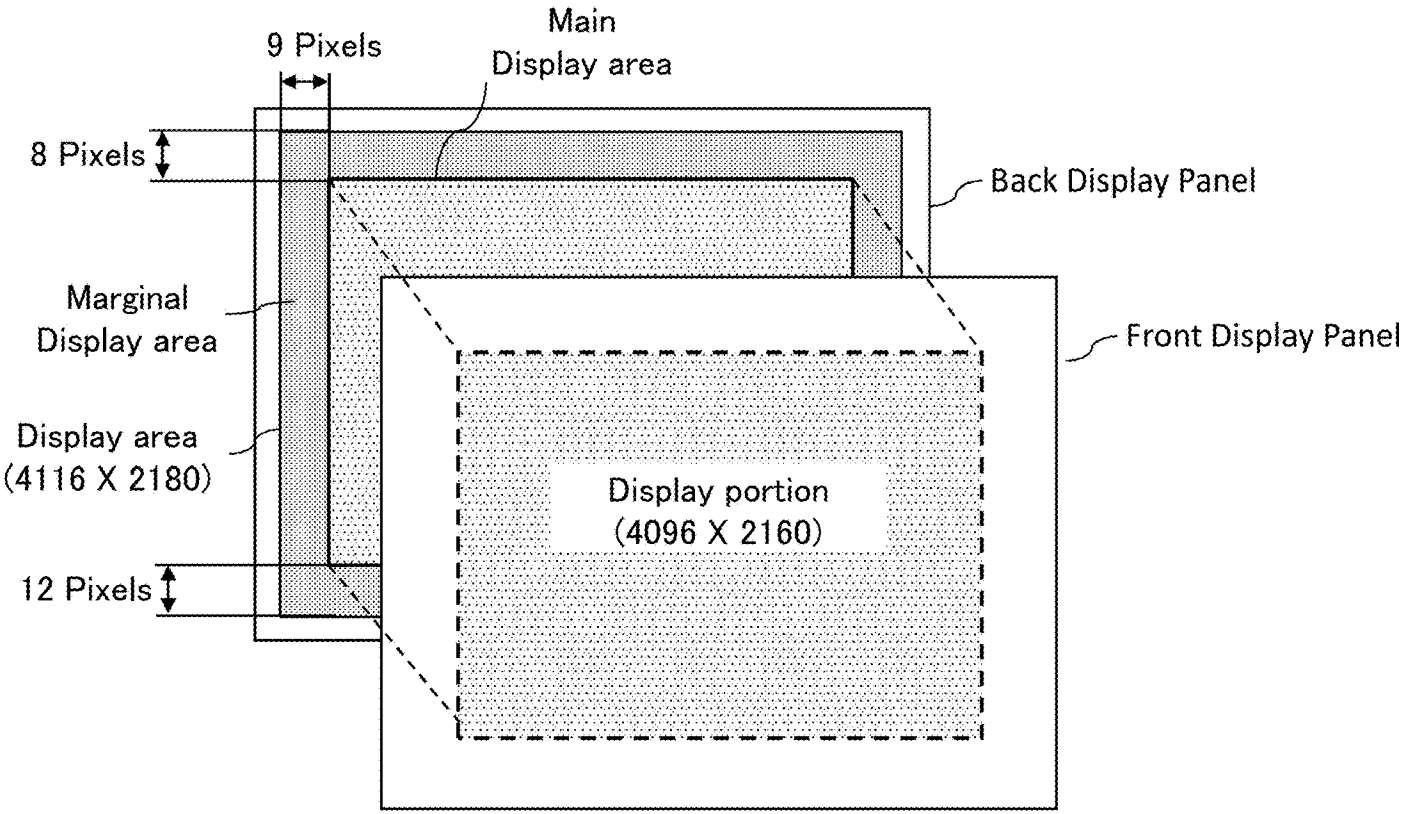
FIG. 15 is a schematic view for illustrating a position of a front display panel and a back display panel stacked adjacent to each other according to the second embodiment.

FIG. 15 is a schematic view for illustrating a position of two display panels stacked adjacent to each other. The front display panel has a display portion with 4096 pixels in the row direction and 2160 pixels in the column direction, arranged in a matrix. The back display panel has a display area with 4116 pixels in the row direction and 2180 pixels in the column direction, arranged in a matrix. A central display area of the back panel display is an area defined by, for example, four corner pixels, pixel (11, 11), pixel (4106, 11), pixel (11, 2170) and pixel (4106, 2170). Here, pixel (X, Y) is a position of a pixel located in X-th pixels in the row direction from a left edge of the display area and in Y-th pixels in the column direction from a top edge of the display area. In an example shown in FIG. 15, an area in the back display panel which overlaps the display portion of the front display panel, is off-set by one pixel left and two pixels up. In other words, an area in the display area overlapping the display portion of the front display panel is defined by four corner pixels, pixel (10, 9), pixel (4104, 9), pixel (10, 2168) and pixel (4104, 2168), which is the main area.

Therefore, when this off-set value is stored in the positional memory as display-position information, the image signal generating unit generates image data so as to display a main image in the main area of the display area of the back display panel. The other area is designated as the marginal area where a marginal image is displayed. The marginal image is generated by the second image signal generating unit so as to prevent an edge area of the liquid crystal display device from being dark even when a viewer looks at the display portion in an oblique angle. The marginal image is generated based on the main image data corresponding to outermost pixels of the first area.

Figure 16:
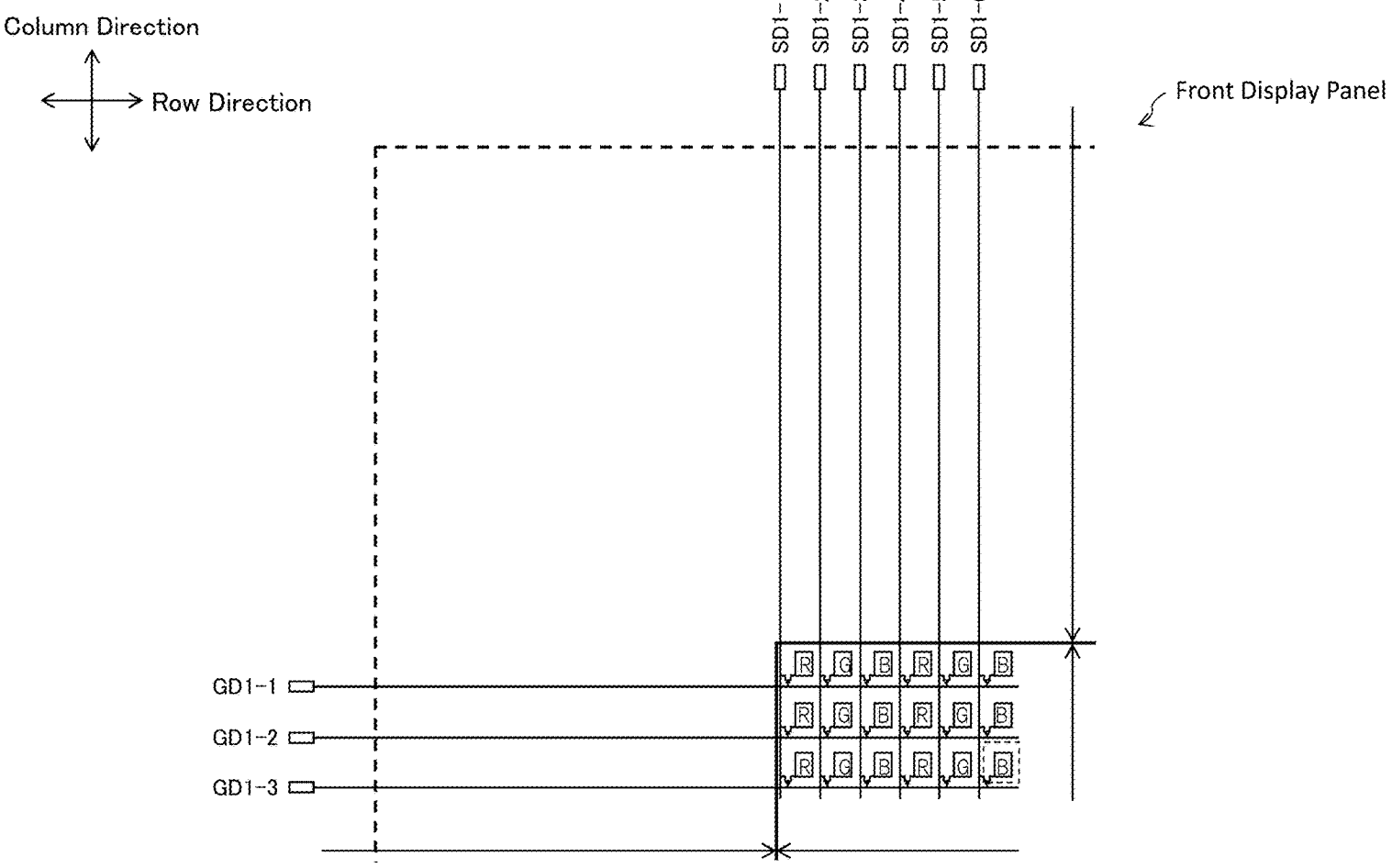
FIG. 16 is an enlarged view of a corner of a display portion of the front display panel.
Figure 17:
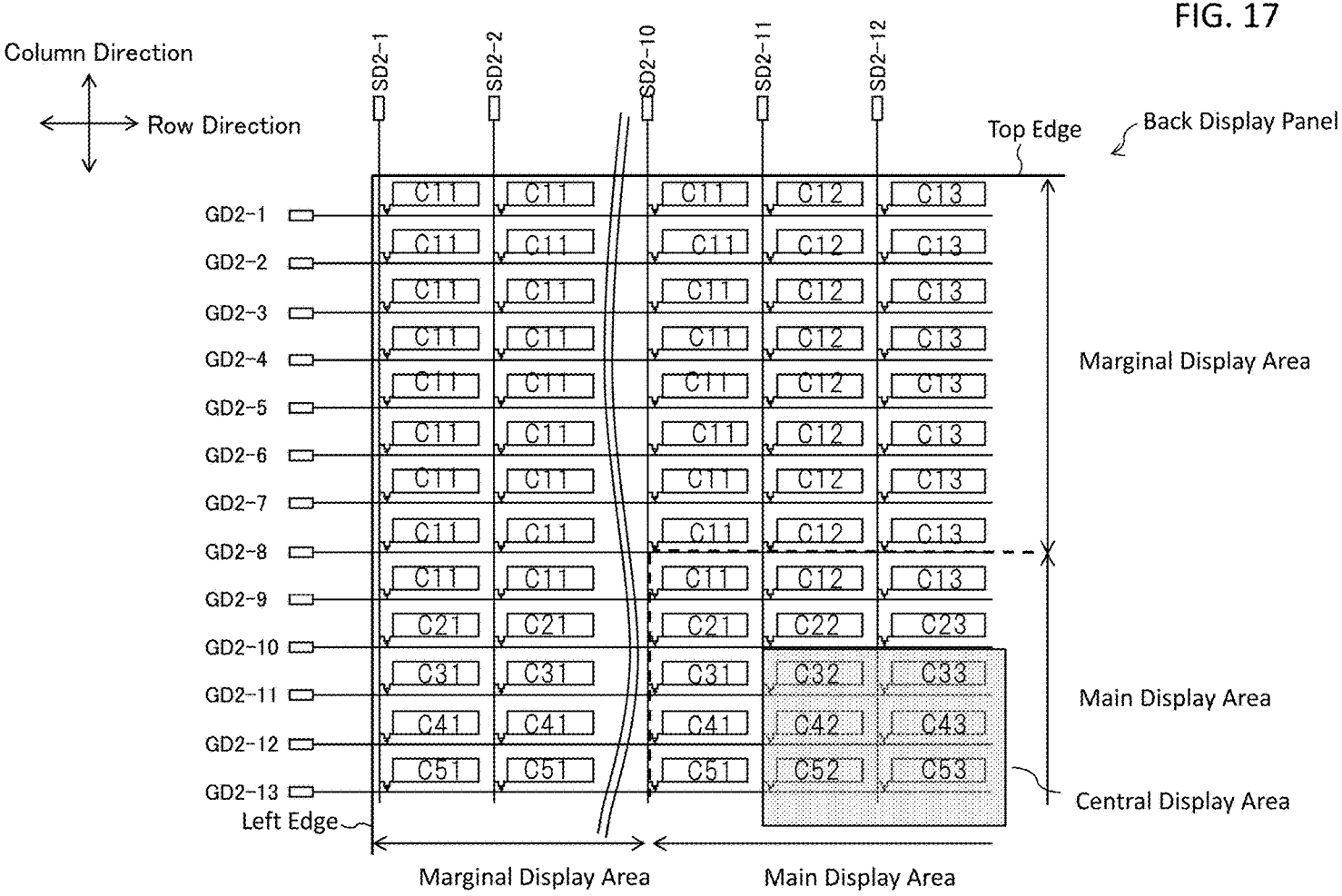
FIG. 17 is an enlarged view of a corner of the display area of the back display panel.

FIG. 16 is an enlarged view of a corner of the display portion, and FIG. 17 is an enlarged view of a corner of the display area. In FIG. 16, "SD1-1"~"SD1-6" indicate 1st to 6th output terminals of the first source driver and "GD1-1"~"GD1-3" indicate 1st to 3th output terminals of the gate driver. The front display panel has a plurality of color filters, a red color filter, a blue color filter, and a green color filter. One pixel in the front display panel consists of a red sub-pixel, a green sub-pixel, and a blue sub-pixel. On the other hand, there is no color filter formed in the front display panel. One pixel in the back display panel is the same size as one pixel in the front display panel, which consists of three sub-pixels. The front and back display panels are stacked adjacent to each other such that each pixel in the front display panel overlaps each pixel in the back display panel in a plan view.

The front and the back display panels are ideally stacked to each other such that a red sub-pixel, which connects with a data line connecting an output terminal SD1-1 of the first source driver, a green sub-pixel, which connects a data line connecting with an output terminal SD1-2 of the first source driver, and a blue sub-pixel, which connects a data line connecting with an output terminal SD1-3 of the first source driver, overlap one pixel which connects a data line connecting an output terminal SD2-11 of the second source driver and connects a gate line connecting an output terminal GD2-11 of the second gate driver. This sometimes fails and an off-set is occurs, such that these three sub-pixels of the front display panel overlap one pixel connecting the data line connecting an output terminal SD2-10 of the second source driver and connects with a gate line connecting an output terminal GD2-9 of the second gate driver. Therefore, the off-set value is stored in the positional memory as display-position information. The first image signal generating unit generates a first display signal so as to display a first image in the main display area based on the display-position information.

The second image signal generating unit generates a second image signal based on the first image signal corresponding to pixels in the outermost area of the main display area, as shown in FIG. 17.

The same image voltage written to a pixel in an edge of the main display area is written to pixels in the second display. For example, pixels from pixel (1, 1) to (10, 1) in the row direction and from pixel (1, 1) to pixel (1, 9) in the column direction display the same image, because the second image signal generating unit generates the second display signal so as to copy the first display signal corresponding to pixel (10, 9) in the main display area to the other pixels in the marginal display area. Pixels in the marginal display area, which is left side of the main display area, display the same luminescence as the pixel on the left edge of the main display area. For example, the first display signal corresponding to pixel (9, 10) in the main display area is copied to the second display signal corresponding to each of pixels (1, 10)≈(8, 10). In the same manner, Pixels in the marginal display area, which is located above the main display area, display the same luminescence as the pixel in the top edge of the main display area. For example, the first display signal corresponding to pixel (11, 9) in the main display area is copied to the second display signal corresponding to each of pixels (11, 1)≈(11, 8). This way of generating a second image signal is a copy of a part of the first image signal. This technique is not limited to this embodiment. The second image signal generating unit may perform a smoothing process on the second image signal so as to make a boundary between the marginal display areas and the main display areas inconspicuous. For example, the second image signal generating unit may generate the second image signal based on the first image signal corresponding to pixels on the edge of the main display area, as well as pixels inside the main display area. The second display signal corresponding to each of pixels (1, 10)≈(9,10) is generated based on the first display signal corresponding to not only pixel (10,10) but also to pixel (11,10) in the main display area. When the second image signal generating unit generates the second image signal based on at least the first image signal corresponding to pixels in the edge of the main display area, it is within a scope of this embodiment.

Third Exemplary Embodiment

A third exemplary embodiment of the present disclosure will be described below with reference to the drawings. For convenience, the components having the same functions as those of the first and second exemplary embodiment are designated by the same reference marks, and their description is omitted.

Figure 18:
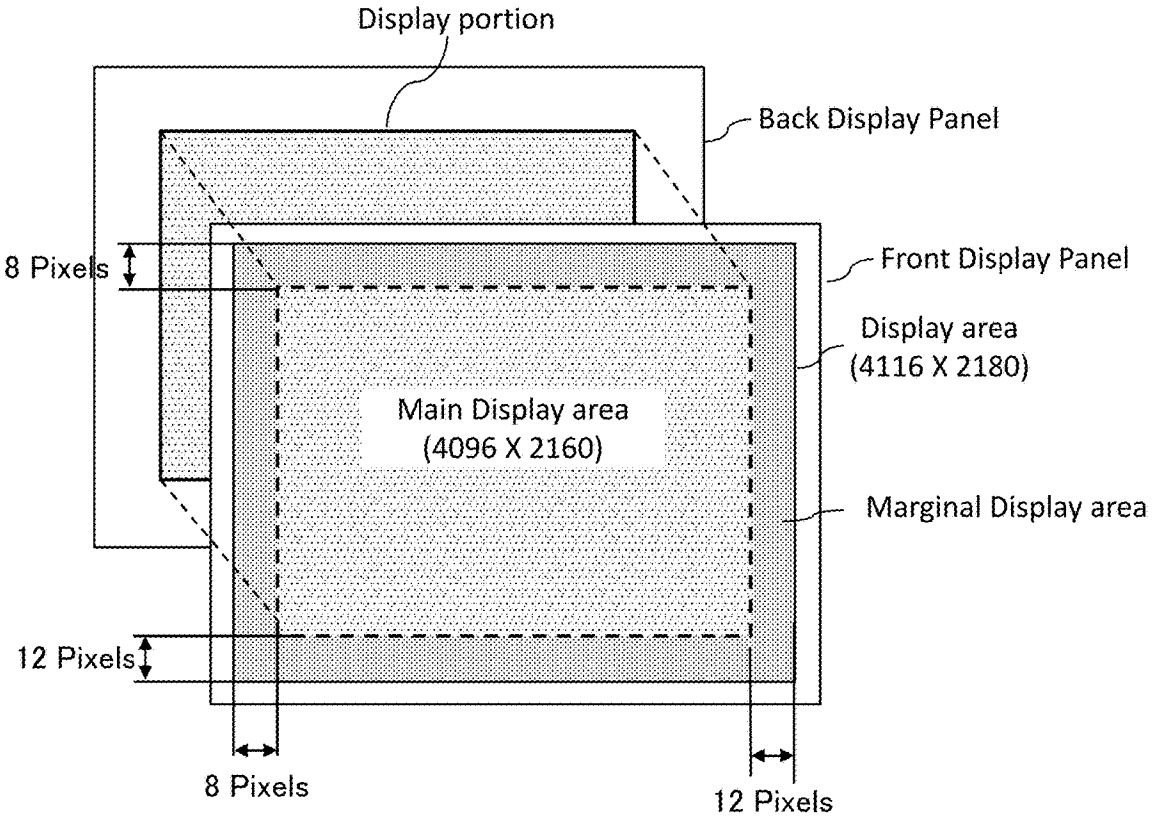
FIG. 18 is a schematic view for illustrating a position of a front display panel and a back display panel stacked adjacent to each other according to a third embodiment.

The liquid crystal display device according to the second embodiment can be applied to a front display panel. FIG. 18 is a schematic view for illustrating a position of two display panels stacked adjacent to each other. More pixels are formed in the front panel than a number of pixels included in an external input image data. On the other hand, the number of pixels formed in the back display panel is less than a number of pixels formed in the front display panel and is the same as a number of pixels included in the external input image data Data. Here, the way of examining how much off-set is occurred is briefly explained. Firstly, the front display panel and the back display panel are stacked adjacent to each other. Secondly, the same pattern of images is displayed in a display portion of the back display panel and a main display area of the front display panel. Thirdly, this pattern of images is inspected to check how much off-set has occurred, by watching these two panels in a normal direction against the display area. This step may be performed not only by human, but also by an automatically system including a camera, for example. Fourthly, the off-set value is stored in the positional memory as display-position information. This process of examination can be applied to the second embodiment. The first image signal generating unit generates a main image to be displayed in a main display area of the front panel based on the display-position information. The main display area overlaps a display portion of the back display panel in a plan view. In this case, the second image signal generating unit generates a second image signal to display a gray scale image, for example, a black image in the marginal display area of the front panel, irrespective of external input image data. A example of the pattern of the image for examination may look like an outer bezel surrounding the main display area.

Fourth Exemplary Embodiment

A fourth exemplary embodiment of the present disclosure will be described below with reference to the drawings. For convenience, the components having the same functions as those of the first, second and third exemplary embodiment are designated by the same reference marks, and their description is omitted.

Figure 19:
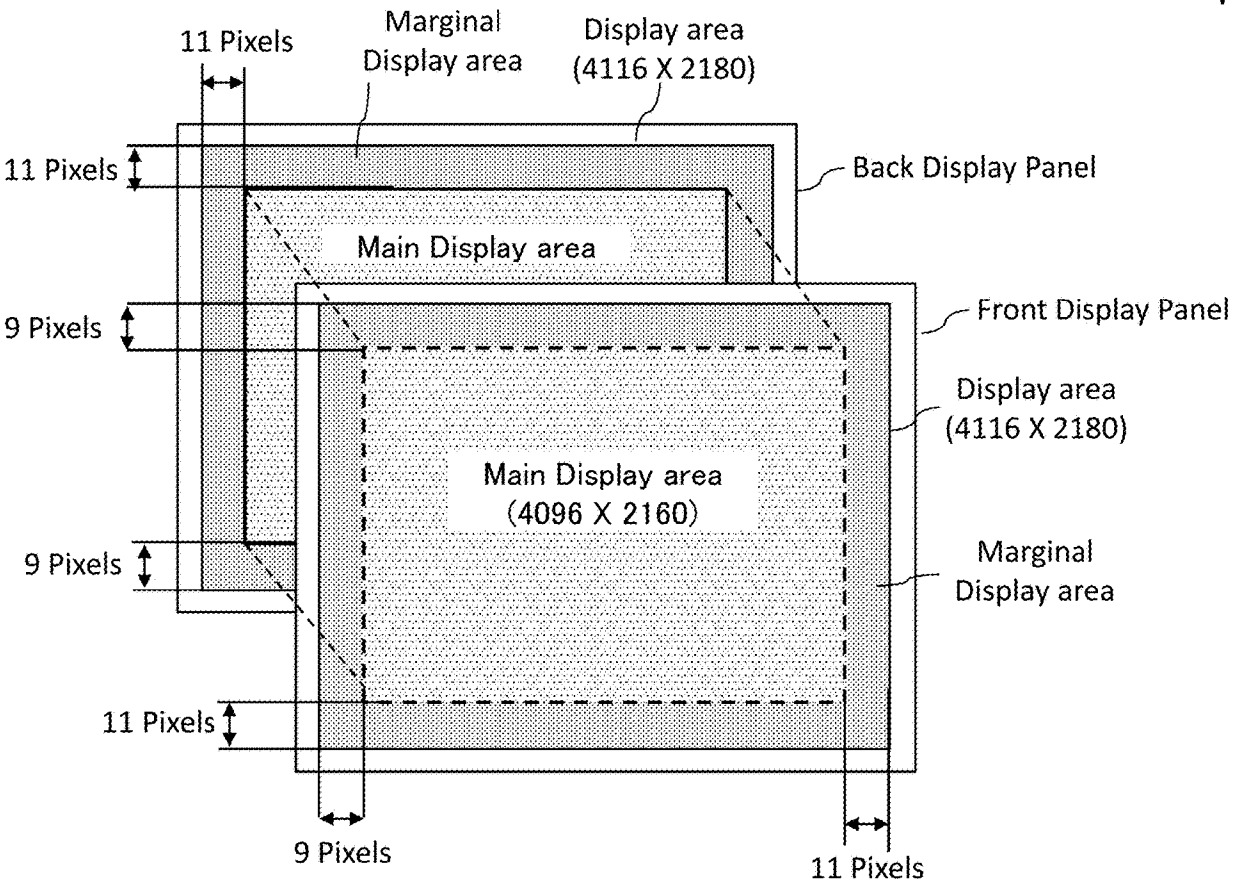
FIG. 19 is a schematic view for illustrating a position of a front display panel and a back display panel stacked adjacent to each other according to a fourth embodiment.

The liquid crystal display device according to the second embodiment can be applied to a front display panel and a back display panel. Both of the front and back display panels have a greater number of pixels than a number of pixels included in an external input image data Data. A main display area in the front display panel includes the same number of pixels as a main display area in the back display panel. A marginal display area in the front display panel includes the same number of pixels as a marginal display area in the back display panel. But the embodiment is not limited to this. The marginal display area in the front display panel may include a different number of pixels compared to the marginal display area in the back display panel. In this configuration, the main display area of the front display panel overlaps the main display area of the back display panel by setting the main display area off the central display area. For example, in FIG. 19, 4116 pixels in the row direction and 2180 pixels in the column direction are arranged in a matrix in both front and back display panels. The central display area is located in an area defined by 4 corner pixels, pixels (11, 11), pixel (4106, 11), pixel (11, 2170) and pixel (4106, 2170). A first image signal generating unit for the back display panel generates the first image signal to display the main image in the main display area defined by 4 corner pixels, pixels (12, 12), pixel (4107, 12), pixel (12, 2171) and pixel (4107, 2171). On the other hand, a first image signal generating unit for the front display panel generates the first image signal to display the main image in the main display area defined by 4 corner pixels, pixels (10, 10), pixel (4105, 10), pixel (10, 2169) and pixel (4105, 2169). After two main display areas set to be above coordination, they are matched in a plan view. In this example, preferably, a marginal display area of the back display panel displays an image based on the first image signal, especially for pixels located on an edge of the main display area. A marginal display area of the front display panel displays a predetermined image, for example, a gray scale image, preferably a black image, irrespective of an external input image data.

Although exemplary embodiments of the present disclosure are described above, the present disclosure is not limited to these exemplary embodiments. It is noted that other embodiments properly changed from the exemplary embodiments described above by those skilled in the art without departing from the scope of the present disclosure are fully supported by the present disclosure.

What is claimed is:

1. A display device includes at least a first display panel and a second display panel stacked on each other, wherein the first display panel and the second display panel each comprises:

a primary display area which comprises a first display area and a second display area which is unique from the first display area and which surrounds the first display area, and wherein the first display panel further comprises:

a control circuit configured to display an image in the primary display area of the first display panel;

an image signal generating circuit configured to generate display data based on an externally input image data for a single image;

wherein the image signal generating circuit comprises a memory which stores display-position information indicating a display location of a first image displayed in the primary display area of the first display panel, wherein the display data comprises first and second display data to be displayed in the first display area and the second display area of the first display panel, respectively, the first display data being generated based on the externally input image data and the display-position information, and wherein the control circuit is configured to cause the first image to be displayed in the first display area of the first display panel based on the first display data, wherein the second display panel includes a display portion, the display portion being configured to display an image based on the externally input image data, the primary display area of the first display panel being larger than the display portion, and wherein outermost pixels of the first display area of the first display panel overlap outermost pixels of the display portion in a plan view.

2. The display device of claim 1, wherein the image signal generating circuit is configured to generate the second display data, the second display data configured to cause a second image to be displayed in the second display area, irrespective of the externally input image data.

3. The display device of claim 2, wherein the second image is a gray scale image.

4. The display device of claim 3, wherein the gray scale image is substantially black.

5. The display device of claim 1, wherein the image signal generating circuit is configured to generate the second display data based on a part of the first display data, which corresponds to the outermost pixels of the first display area of the first display panel.

6. The display device of claim 5, wherein the second display data is generated by copying the part of the first display data corresponding to the outermost pixels of the first display area of the first display panel.

7. The display device of claim 1, wherein the second display area of the first display panel extends from the first display area of the first display panel and extends in at least one of a first and second direction, the first and second direction crossing each other.

8. The display device of claim 1, wherein the display-position information includes off-set information from a normal area, wherein the normal area is a central area in the primary display area of the first display panel.

9. The display device of claim 1, wherein the display-position information includes at least a position of one corner of the first display area of the first display panel.

10. The display device of claim 1, wherein the first display panel displays in monotone, and the second display panel displays in color.

11. The display device of claim 10, wherein the image signal generating circuit is configured to generate the second display data based on at least a part of the first display data corresponding to the outermost pixels of the first display area of the first display panel.

12. The display device of claim 1, wherein the first display panel displays in color, and the second display panel displays in monotone.

13. The display device of claim 1 further includes a positional change circuit, wherein the positional change circuit is configured to rewrite the display-position information stored in the memory.

14. A display device includes at least a first display panel and a second display panel stacked on each other, wherein each of the first display panel and the second display panel comprises:

a primary display area which comprises a first display area and a second display area which is unique from the first display area and which surrounds the first display area;

a control circuit configured to display an image in the primary display area of the first display panel; and an image signal generating circuit configured to generate display data based on externally input image data, wherein the image signal generating circuit comprises a memory which stores display-position information indicating a display location of a first image displayed in the primary display area of the first display panel, the display data comprises first and second display data to be displayed in the first display area and the second display area of the first display panel, respectively, the first display data being generated based on the externally input image data and the display-position information, and the control circuit is configured to cause the first image to be displayed in the first display area of the first display panel based on the first display data, wherein outermost pixels of the first display area in the first display panel overlap outermost pixels of the first display area in the second display panel in a plan view.

15. The display device of claim 14, wherein the first display area in the first display panel is a same area as the first display area in the second display panel.

16. The display device of claim 14, wherein the image signal generating circuit is configured to:

generate the second display data for the first display panel so as to display a substantially black image in the second display area of the first display panel, and generate the second display data for the second display panel based on at least a part of the first display data corresponding to the outermost pixels of the first display area of the first display panel.

* * * * *